US011344780B2

(12) United States Patent
Marciano

(10) Patent No.: US 11,344,780 B2
(45) Date of Patent: May 31, 2022

(54) STRIKE DETECTION EQUIPMENT

(71) Applicant: Frederic Marciano, Schiltigheim (FR)

(72) Inventor: Frederic Marciano, Schiltigheim (FR)

( * ) Notice: Subject to any disclaimer, the term of this patent is extended or adjusted under 35 U.S.C. 154(b) by 367 days.

(21) Appl. No.: 16/481,732

(22) PCT Filed: Jan. 26, 2018

(86) PCT No.: PCT/EP2018/052002

§ 371 (c)(1),
(2) Date: Jul. 29, 2019

(87) PCT Pub. No.: WO2018/141650

PCT Pub. Date: Aug. 9, 2018

(65) Prior Publication Data

US 2019/0388756 A1 Dec. 26, 2019

(30) Foreign Application Priority Data

Jan. 31, 2017 (FR) ..... 1770091

(51) Int. Cl.
*A63B 69/00* (2006.01)
*A63B 24/00* (2006.01)
(Continued)

(52) U.S. Cl.
CPC ..... *A63B 69/004* (2013.01); *A63B 24/0062* (2013.01); *A63B 71/0622* (2013.01);
(Continued)

(58) Field of Classification Search
CPC ..... A63B 69/004; A63B 24/0062; A63B 71/0622; A63B 71/10; A63B 71/1225;
(Continued)

(56) References Cited

U.S. PATENT DOCUMENTS 3,866,909 A * 2/1975 DeSantis ..... A63B 69/004 482/88
5,184,831 A * 2/1993 Garner ..... A63B 69/004 200/512
(Continued)

FOREIGN PATENT DOCUMENTS

FR 2913181 A1 9/2008
JP 2000042162 A 2/2000
(Continued)

OTHER PUBLICATIONS

International Search Report dated Mar. 5, 2018 for PCT/EP2018/052002.

*Primary Examiner* — Sundhara M Ganesan
(74) *Attorney, Agent, or Firm* — Maxwell L. Minch; Maxwell L Minch Esq. PA

(57) ABSTRACT

The present invention concerns a hit detection equipment, usable by a fighter and an opponent for martial arts such as taekwondo, karate or boxing, comprising a central device, a valid surface, for example a jersey and/or a helmet, and at least one authorized surface, for example a glove and/or a shoe. Said valid surface comprises at least one conductive surface and said authorized surface comprises two conductive structures insulated from each other, intertwined with each other over the entire said authorized surface, and each connected to an electrical terminal, and configured so that a contact of said authorized surface on a conductive surface creates a short circuit between the two conductive structures. The present invention also concerns a method for detecting a hit struck by a fighter on an opponent, for martial arts such as taekwondo, karate or boxing, each equipped with an equipment according to the invention.

16 Claims, 2 Drawing Sheets

(51) Int. Cl.

| | |
|---|---|
| ***A63B 71/06*** | (2006.01) |
| ***A63B 71/10*** | (2006.01) |
| ***A63B 71/12*** | (2006.01) |
| ***A63B 71/14*** | (2006.01) |

(52) U.S. Cl.
CPC ..... *A63B 71/10* (2013.01); *A63B 71/1225* (2013.01); *A63B 71/145* (2013.01); *A63B 2071/0694* (2013.01); *A63B 2071/1208* (2013.01); *A63B 2071/1283* (2013.01); *A63B 2209/10* (2013.01); *A63B 2220/40* (2013.01); *A63B 2220/53* (2013.01); *A63B 2220/836* (2013.01); *A63B 2225/50* (2013.01); *A63B 2225/74* (2020.08); *A63B 2244/102* (2013.01); *A63B 2244/106* (2013.01)

(58) Field of Classification Search
CPC ..... A63B 71/145; A63B 2225/74; A63B 2071/0694; A63B 2071/1208; A63B 2071/1283; A63B 2209/10; A63B 2220/40; A63B 2220/53; A63B 2220/836; A63B 2225/50; A63B 2244/102; A63B 2244/106; A63B 71/06; A63B 71/12; A63B 71/146
See application file for complete search history.

(56) References Cited

U.S. PATENT DOCUMENTS

| | | | | |
|---|---|---|---|---|
| 8,696,422 | B1 * | 4/2014 | Santiago | A63B 69/26 463/8 |
| 9,227,128 | B1 * | 1/2016 | Carfagna, Jr. | A63B 24/0087 |
| 2002/0037759 | A1 * | 3/2002 | Aldridge | A63B 71/12 463/1 |
| 2003/0163287 | A1 * | 8/2003 | Vock | A43B 3/0005 702/187 |
| 2003/0217582 | A1 * | 11/2003 | Reinbold | A63B 69/32 73/12.09 |
| 2004/0009851 | A1 * | 1/2004 | Lovison | A63B 69/004 482/84 |
| 2004/0171412 | A1 * | 9/2004 | Vollmar, Jr. | A63B 71/12 463/8 |
| 2005/0172791 | A1 * | 8/2005 | Aldridge | A63B 69/34 84/743 |
| 2006/0161356 | A1 * | 7/2006 | Desroses | A63B 71/0605 702/41 |
| 2009/0176632 | A1 * | 7/2009 | Wiber | A63B 69/004 482/84 |
| 2009/0235761 | A1 * | 9/2009 | Song | A63B 71/0605 73/862.59 |
| 2009/0293587 | A1 * | 12/2009 | Mages | A63B 71/0605 73/12.01 |
| 2010/0144414 | A1 * | 6/2010 | Edis | G16H 20/30 463/8 |
| 2010/0307222 | A1 * | 12/2010 | Oberleitner | A63B 69/38 73/12.04 |
| 2011/0053737 | A1 * | 3/2011 | Chang | G01L 9/0052 482/83 |
| 2011/0098094 | A1 * | 4/2011 | Forsell | A63B 69/02 463/8 |
| 2011/0130183 | A1 * | 6/2011 | Pelletter | A63B 69/004 463/7 |
| 2011/0159939 | A1 * | 6/2011 | Lin | A63B 69/32 463/8 |
| 2011/0251802 | A1 * | 10/2011 | Song | A63B 69/004 702/41 |
| 2012/0053016 | A1 * | 3/2012 | Williamson | A63B 24/0062 482/8 |
| 2012/0198593 | A1 * | 8/2012 | Beck | G01L 5/0052 2/2.5 |
| 2012/0214647 | A1 * | 8/2012 | Ji | A63B 71/0616 482/8 |
| 2012/0279311 | A1 * | 11/2012 | Helmer | F41J 5/056 73/768 |
| 2013/0130870 | A1 * | 5/2013 | McCranor | A63B 63/003 482/83 |
| 2013/0324370 | A1 * | 12/2013 | Harrigan | A63B 69/004 482/84 |
| 2015/0157913 | A1 * | 6/2015 | McCranor | A63B 71/141 482/84 |
| 2015/0375079 | A1 * | 12/2015 | Wood | A63B 71/06 482/8 |
| 2016/0059102 | A1 * | 3/2016 | Williamson | A63B 69/201 482/8 |
| 2016/0263458 | A1 * | 9/2016 | Mather | G06K 9/0055 |
| 2017/0157488 | A1 * | 6/2017 | Migliorati | A63B 71/0605 |
| 2017/0225032 | A1 * | 8/2017 | Jones | A63B 71/148 |
| 2017/0319931 | A1 * | 11/2017 | Yachin | G09B 19/0038 |
| 2018/0028891 | A1 * | 2/2018 | DeLaRosa | A63B 69/34 |
| 2018/0161659 | A1 * | 6/2018 | Chung | A63B 71/0622 |
| 2018/0326283 | A1 * | 11/2018 | Sexton | A61B 5/1112 |
| 2018/0326289 | A1 * | 11/2018 | Park Lee | A63B 71/08 |
| 2020/0188758 | A1 * | 6/2020 | Song | A63B 69/004 |

FOREIGN PATENT DOCUMENTS

| | | | |
|---|---|---|---|
| WO | 2004004840 | A1 | 1/2004 |
| WO | 2010041304 | A1 | 4/2010 |
| WO | 2011050391 | A1 | 5/2011 |

* cited by examiner

STRIKE DETECTION EQUIPMENT

The present invention is in the field of combat sports such as taekwondo, karate or boxing. It concerns more particularly a hit detection equipment.

The present invention concerns sports such as taekwondo, karate, boxing, but is not limited to these examples and applies to any combat sport that can benefit from hit detection equipment. In such sports, determining the number of valid hits made to the opponent can be a judging criterion in order to determine the winner of a fight. For a hit to be valid, several rules may apply depending on the sport concerned.

The hit may have to be struck on a so-called valid surface of the opponent's body. Valid surfaces can be defined by accessories or well-defined surfaces, for instance a coloured chest protector or helmet for taekwondo.

Only certain well-defined surfaces can be allowed to strike a valid hit. It can be for instance the tips of gloves, fists or feet.

Two conditions must then be verified for a hit to be declared valid. The first condition is the contact between a surface authorised to strike and a surface known as the opponent's valid surface. The second condition is a sufficient intensity of the hit. Thus, a simple touch may not be enough to grant a point.

A hit detection system must therefore consider these two factors and be able to detect contact, as well as the intensity of the hit.

Finally, the detected hits must then be signalled, either directly on the fighters, or on a display.

Detection systems exist, especially for taekwondo. In order to detect contact, some systems use a chest protector lined with Hall effect sensors capable of detecting the proximity of magnets placed in the opponent's shoes and gloves. Other systems use RFID sensors. A rigid chest protector lined with piezoelectric sensors is used to measure the intensity of the hits.

But these systems do not provide sufficiently reliable detection. Indeed, Hall effect contact is not always well detected, while the use of RFID chips is very random. The piezoelectric sensors on the chest protector are unreliable after repeated hits on the same surface, and non-working areas appear quickly.

According to Olympic Games statistics, the combination of these technologies leads to detection devices that do not detect up to 30% of the hits.

In addition, such a rigid chest protector hinders the fighter's movements by its heaviness and rigidity.

These systems are also very expensive, which prevents significant spread among the practitioners of the sports concerned. Finally, information about the detected hits is sent through radio waves to be displayed on a screen located near the fighting area. These waves, usually sent in standard public frequency bands, such as 430 MHz, 860 MHz, 2.4 GHz or 5.6 GHz in Europe, are easily jammed, further reducing the efficiency of the detection system.

In addition, some martial arts have rules regarding hit discrimination. In karate, for example, a valid hit makes it impossible for the opponent to strike a valid hit for a given time delay. The lack of stability of radio waves makes it difficult for existing detection systems to apply this type of rule properly.

Document JP200000042162 proposes a hit detection equipment consisting of a chest protector or helmet with two electrodes, and a glove or sock with a conductive surface. When the glove hits the chest protector, the conductive surface touches the electrodes and causes a short circuit which is detected. The two electrodes are arranged in the shape of intertwined combs, so that the hit can be detected over the entire surface of the chest detector or helmet. Deformable protruding elements can be placed between the two electrodes. A hit must then be struck hard enough to deform the protruding elements and cause the short circuit, and too weak hits are not detected. Detection information is transmitted by radio to be displayed on a screen.

However, with such a solution, the equipment detects indifferently both the hits delivered by the opponent and the hits delivered by the fighter himself. In addition, the chest protector is still rigid and hinders the fighter's movements.

Document WO2010041304 proposes a similar hit detection equipment comprising a pair of electrodes on the striking surface as well as on the receiving surface. Such electrodes do not constitute a surface, but rather wires, laid in series and/or in parallel. It can happen during a hit that each electrode of the striking surface comes into contact with one of the electrodes of the surface receiving the hit, and thus the hit will not be detected.

The purpose of this invention is to compensate at least in part for these disadvantages. To this end, it proposes a hit detection equipment, which can be used by a fighter and an opponent for martial arts such as taekwondo, karate or boxing, comprising a central device, a valid surface, for example a jersey and/or a helmet, and at least one authorised surface, for example a glove and/or a shoe. This hit detection equipment is particular in that said valid surface comprises at least one conductive surface and in that said authorized surface comprises two conductive structures insulated from each other, intertwined with each other over the entirety of said authorized surface, and each connected to an electrical terminal, and configured so that a touch of said authorized surface on a conductive surface creates a short circuit between the two conductive structures.

Thanks to these provisions, reliable hit detection can be achieved using simple, inexpensive and lightweight detection equipment, making it more comfortable and practical for sports practice. Due to its surface span, the presence of a conductive surface allows a much higher detection reliability than the presence of wires, even intertwined, but separated by an insulator, from the state of the art.

According to other features:

- said central device may include a transmitter of signals capable of being transmitted between a fighter and his opponent by means of contact between said authorized surface of said fighter and said conductive surface of said opponent. Thus, hit detection information can be exchanged in a simple and reliable way between the fighter's and his opponent's hit detection equipment, without vulnerability to interference,
- said signals may be low frequency signals, typically in the order of 100 kHz, which allows contact transfer,
- said conductive structures may be arranged in the form of two combs or two spirals, intertwined one inside the other, these simple embodiments making it possible to detect a hit on all authorized surfaces through short-circuit between the conductive structures,
- said conductive surface may comprise woven or knitted conductive yarns, in particular silver-coated polyamide or stainless-steel conductive yarns, which makes it possible to obtain effective conductive surfaces, with an appearance and comfort equivalent to the textiles usually used for the practice of sport,
- the hit detection equipment may also include at least one impact sensor, preferably an accelerometer, to measure the impact of the hits and to dissociate, for example, hits of insufficient intensity from valid hits, the hit detection equipment may also include a gyroscope, capable of detecting a 180° rotation, allowing in some sports to detect special hits, for example rotation kicks in taekwondo, the hit detection equipment may also include at least one visual transmitter, such as a LED, capable of receiving a lighting command from said central device, allowing the information of hits given and/or received to be displayed in real time on the fighters, a plurality of transmitters making it possible to distinguish between different types of hits; these provisions allow the referees to count the hits reliably without having to rely on a transmission of information between the detection equipment's and a point counting system located outside the fighting area.

The present invention also concerns a method of detecting a hit stroke by a fighter on an opponent, for martial arts such as taekwondo, karate or boxing, each equipped with an equipment according to one of the previous claims, comprising the following steps:

establishment of a contact between an authorized surface of said fighter and a valid surface of said opponent, detection of a short circuit between the two conductive structures of said authorized surface, creation at the level of the equipment of said fighter of a low frequency signal characteristic of the hit, sending, during said contact, said low frequency signal to the opponent's central device, by means of the contact between the authorized surface of said fighter and the valid surface of said opponent, sending, if necessary, a lighting command to visual transmitters such as LEDs of the opponent's equipment.

Thanks to these provisions, reliable hit detection can be achieved using simple, inexpensive and lightweight detection equipment, making it more comfortable and practical for sports practice. In addition, visual signalling of strikes by the visual means can allow reliable counting of points without having to rely on information transmission between detection equipment and a point counting system located outside the fighting area.

According to other features:

said method may also include, at the level of the opponent's equipment at the time of reception of a signal, and depending on the nature of the signal received, neutralising the creation of signals for a predetermined period of time, thus making it possible to apply a discrimination of hits in the sports concerned by such rules, i.e. not to count the hits given within a certain interval of time after a received hit.

This invention will be better understood when reading the following detailed description, with reference to the attached figures in which.

Figure 1:
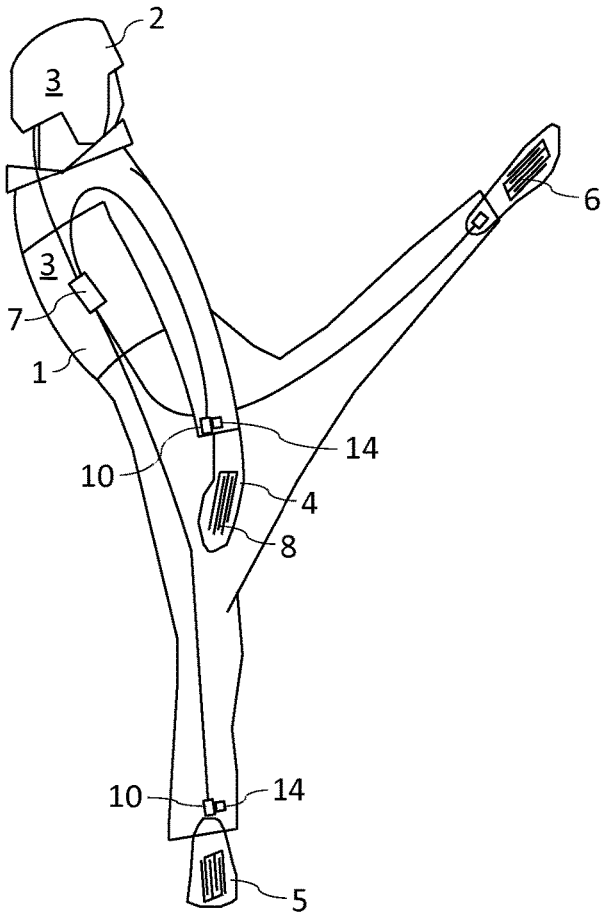
FIG. 1 is a schematic view of a fighter practicing taekwondo, equipped with a hit detection equipment according to the invention.
Figure 2:
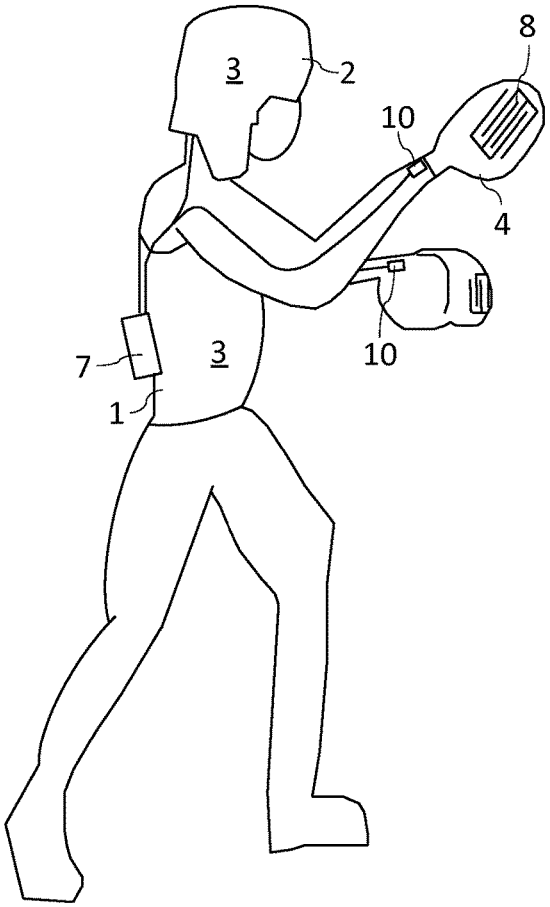
FIG. 2 is a schematic view of a fighter practicing boxing, equipped with a hit detection equipment according to the invention.

The hit detection equipment according to the invention, as shown in FIGS. 1 to 8, is intended to be worn by a fighter practising a martial art such as taekwondo, karate or boxing. The hit detection equipment includes valid surfaces, for example a jersey 1 and/or a helmet 2 comprising a conductive surface 3 as a valid surface, a glove 4 and/or a shoe 5 comprising two conductive structures 6, and a central device 7.

Figure 3:
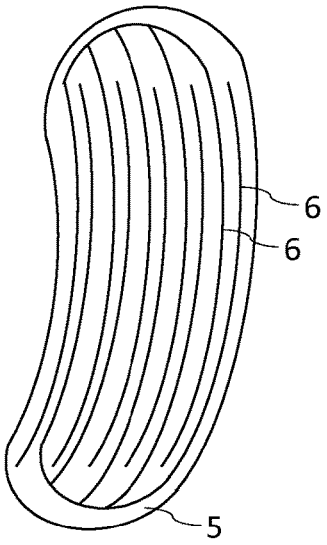
FIG. 3 is a view of a detail of the shoe in FIG. 1, according to a first embodiment of the invention.
Figure 4:
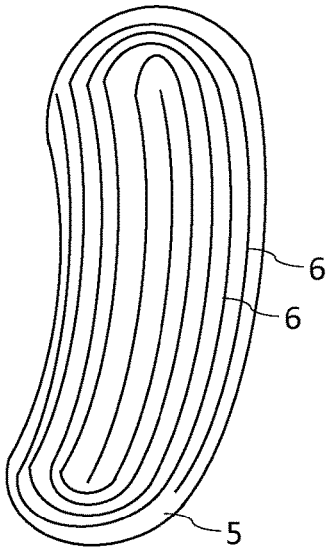
FIG. 4 is a view of a detail of the shoe in FIG. 1, according to a second embodiment of the invention.

The conductive structures 6 are intertwined on the entire authorized surface 8 of the glove 4 and/or the shoe 5. The authorised surface 8 is all the areas authorised to strike hits according to the rules of the sport practised. The authorized surface 8 is not necessarily limited to gloves 4 and shoes 5. If, for example, the knee or elbow was authorized to strike, then the knee or elbow would also be equipped with two conductive structures 6. Conductive structures 6 may, for example, be arranged in the form of intertwined combs, as shown in FIG. 3, or in the form of intertwined spirals, as shown in FIG. 4. Other arrangements allowing the intertwining of the two conductive structures 6 on all authorized surfaces 8 are possible without leaving the scope of the present invention. The two conductive structures 6 are insulated from each other, so that direct contact between them is impossible. On the other hand, if the two conductive structures 6 touch the same conductive body, it establishes a short circuit between them, which can be detected by the central device 7.

Conductive structures 6 may be made of conductive yarns, made for example of silver or stainless steel. These conductive yarns may be embroidered on the surface of the glove 4, shoe 5 or any other authorized surface 8.

The conductive surface 3 can extend to all surfaces on which a hit is valid according to the rules of the sport practiced, for example the helmet 2 and/or jersey 1. The distribution of conductive surfaces 3 on the fighter is not necessarily limited to the helmet 2 and jersey 1. Conductive surface 3 may be made of conductive textiles, for example a woven fabric with warp and/or weft lines at regular intervals, made of silver-coated polyamide or stainless steel yarns. It is also possible to make the conductive surface 3 with a knitting made of conductive yarns. Conductive surfaces 3 may also be covered with a conductive material or moulded from conductive rubber. Such an embodiment may be suitable for a helmet 2 made of a rigid material. In particular, it is possible to make a helmet 2 moulded in polyurethane, then over-mould it with a thin layer of conductive rubber.

In the present application, conductive surface 3 refers to a set of points defining a geometric shape that extends significantly in two dimensions. The conductive surface 3 cannot therefore consist of a set of two mainly one-dimensional elements separated by an insulator, such as that of the state of the art described in the introduction, in which one of the dimensions is much smaller than the other, so that one cannot be sure of detecting the hits. For example, if one of the electrodes on the authorized surface 8 touches an insulating part between the two electrodes, the hit is not detected.

The hit detection is much more reliable with a conductive surface 3 in the sense of the present invention.

In addition, conductive surface 3 is a conductive surface in the sense that it is conductive over its entire surface. It is therefore at the same electrical potential over its entire surface, it can be said that it is a mono potential conductive surface. This allows for reliable detection; when an authorized surface 8 comes into contact with such a conductive surface, the two electrodes of said authorized surface are necessarily electrically connected, regardless of where on the surface each electrode has touched, and the hit is detected.

The conductive surface 3 can be connected by wire to the central device 7, for example by a simple electric wire ended with a crocodile clip, in order to transmit information received, for example, during a hit.

Figure 5:
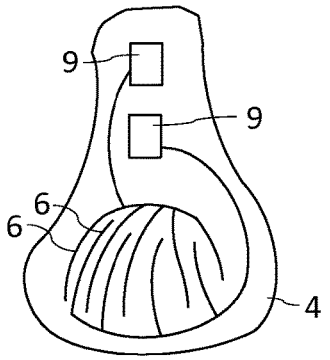
FIG. 5 is a top view of the glove in FIG. 2, according to a first embodiment of the invention.
Figure 6:
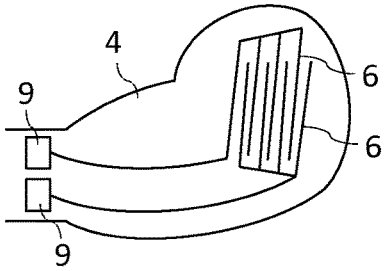
FIG. 6 is a profile view of the glove in FIG. 5.
Figure 7:
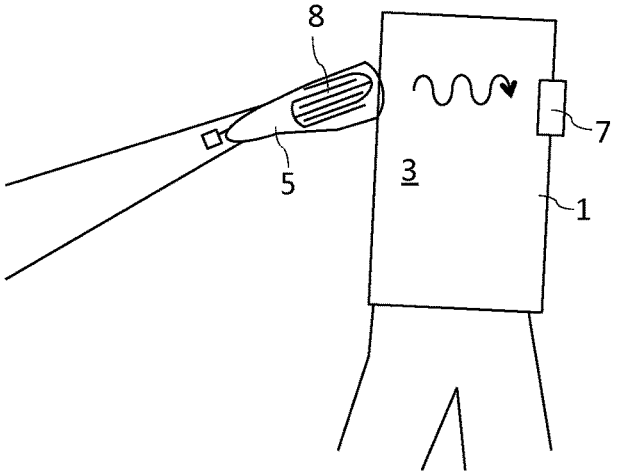
FIG. 7 is a schematic view of a detected hit with the hit detection equipment according to the invention.

As shown in FIGS. 5 and 6, each conductive structure 6 of an intertwined pair of conductive structures 6 of an authorized surface 8 is connected to an electrical terminal 9. When two intertwined conductive structures 6 and a conductive surface 3 come into contact, the electrical terminals 9 are short circuited. To do this, the distance between the conductive structures 6 must be small enough so that a hit from an authorized surface 8 on a valid surface will inevitably cause a short circuit, while ensuring that the two conductive structures 6 are well insulated from each other.

The two electrical terminals 9 are part of an end sensor 10, for example a foot end sensor or a glove end sensor. The end sensor 10 can be connected by wire to the central device 7 in order to be supplied with electrical power, and exchange information with said central device 7.

The central device 7 may be attached to the back of the jersey 1. The end sensor 10 may comprise a wired interface for its connection to the central device 7. The end sensor may also have a mechanical and electrical attachment that can be easily removed from the authorized surface 8. This attachment may for example be a conductive Velcro (registered trademark) attachment. There can thus be two such attachments, materializing the electrical terminals 9. This arrangement allows gloves 4 and/or shoes 5 to be easily removed at the end of a fight, without them always being connected to the end sensor 10. in this embodiment, prior to a fight, the preparation of the fighters is simplified and may include the following steps:

- putting on gloves 4 and/or shoes 5 and/or other equipment comprising authorized surfaces,
- fixing of the central device 7 and the various electrical circuits on the fighters,
- connecting the authorized surfaces 8 to the corresponding electrical circuits at the end sensors 10.

The end sensor 10 continuously monitors the short circuit status between the two electrical terminals 9. When a short circuit is detected at an authorized surface 8, the end sensor 10 sends a signal, preferably a low frequency signal, directly from said authorized surface 8 to the opponent's touched valid surface. In a preferred embodiment, said signal has a frequency between 50 and 300 kHz, typically in the order of 100 kHz. The signal is then transmitted using the wire connecting the conductive surface 3 to the central device 7, and is finally detected by the central device 7.

In a preferred embodiment, the hit detection equipment includes an impact sensor 14, which can be placed on the forearm and/or heel, and can determine the intensity of a hit. The impact sensor may be an accelerometer, and can be connected to the end sensor 10. When a short-circuit contact is detected between electrical terminals 9, the impact sensor makes it possible to determine whether the intensity of the hit is sufficient for the hit to be valid. The transmitted signal may then have a different frequency depending on whether the hit is valid or not.

It can also be provided that the detection of the contact by short-circuit of an authorized surface, as well as the information of the intensity of the hit, are transmitted to the central device 7. The latter then determines the type of hit: for example, a kick, if the short-circuit contact detection information comes from an authorized surface of a shoe 5, of sufficient or insufficient intensity according to the value measured by the impact sensor. Depending on the type of hit, the central device 7 determines the frequency of the signal to be transmitted. This signal is transmitted during the contact of the hit, directly to the opponent's valid surface, from where it is transmitted to the opponent's central device 7.

The hit detection equipment may also comprise a gyroscope, capable of detecting a rotation of e. g. 180° or 360°. Such an arrangement can be used in some sports, for example in taekwondo additional points are awarded for a rotating kick. The information transmitted by the signal, in particular the choice of its frequency, to the opponent's central device 7 may then include these additional details required for the calculation of the points.

The signal sent by the conductive structures 6 to the opponent's central device 7 may then carry different informations, distinguished for example by the use of different frequencies. The opponent's central device 7 may be informed of a valid hit, a hit of insufficient intensity, a special hit with more points according to the gyroscope data. The opponent's central device 7 can also be informed if the hit is a kick or a punch. It can itself determine on which part of the body it has been hit, for example on the head or chest, depending on the authorized surface from which the information is received.

Figure 8:
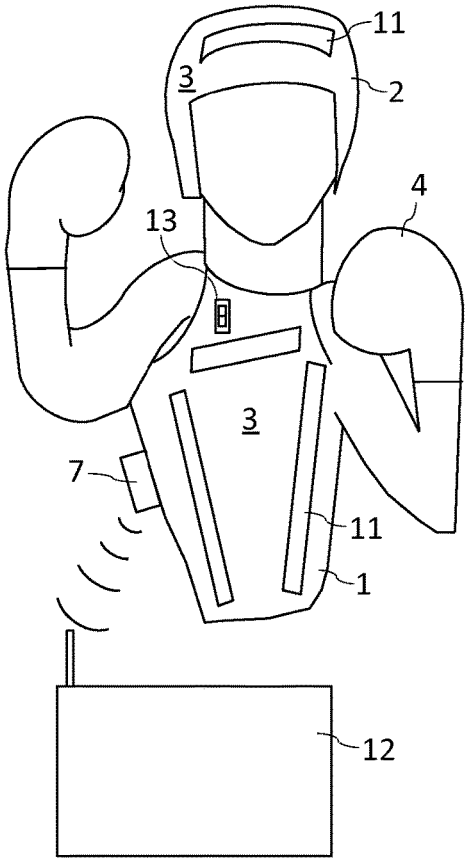
FIG. 8 is a schematic view of the communication between a central device and a receiver according to the invention.

As shown in FIG. 8, the hit detection equipment may also include a visual transmitter 11, consisting for example of one or more LEDs. For example, the visual transmitter 11 can be placed on the helmet 2 and/or the fighter's clothing, and connected by wire to the central device 7. When the central device 7 is informed of a received hit, it can command the visual transmitter 11 associated with the valid surface that received the hit, a certain display. It can be arranged that the central device 7 commands the visual transmitter 11 to show a different display, for example by activating LEDs of different colours when a contact of insufficient intensity is detected. The display can also differentiate between kicks and punches, and special hits such as a rotating kick. It can be arranged that if the hit was received at the level of the helmet 2, it is the LED of the helmet 2 that lights up, whereas if the hit was made at the level of the chest, it is a LED at the level of the chest that lights up; according to the importance of the location of the hit, and its precision, the conductive surfaces 3 can be divided to detect the location of the hits with more or less precision. This can be used to count points if a regulation stipulates it, but also for training assistance, by indicating to the fighter that he is more vulnerable in certain areas, and thus encouraging him to further train his defence in this area.

As shown in FIG. 8, information about the hits received can also be sent by the central device 7 to a screen 12 outside the fighting area, for example by sending a radio wave. Screen 12 may be visible to the referees and the public and allow them to follow the score evolution. In the event of a radio problem, the presence of the visual transmitter 11 ensures that the hits are correctly counted by the referees.

The hit detection equipment makes it possible to implement a detection method comprising the following steps:

- a hit delivered by a fighter to his opponent, by contact of an authorised surface of said fighter and a valid surface of said opponent
- short circuit between the two conductive structures 6 of said authorized surface of said fighter, for example a glove 4 or a shoe 5, by contact with the conductive surface 3 of a valid surface of the opponent's equipment, creation at the level of said fighter, for example in his central device 7, of a low-frequency signal characteristic of the hit, sending said low-frequency signal to the opponent's central device 7, via the fighter's authorised surface to the opponent's valid surface during contact, sending, if necessary, a lighting command to a visual transmitter 11 such as leds arranged on said fighter.

As shown in FIG. 8, the hit detection equipment may also include a display 13 to display on each fighter the points he has acquired. This allows an additional check of the score at the end of the battle.

The central device can store the recorded data for use in targeted training. For example, it can be learnt from this data that the fighter is more effective with the right foot, or the left fist, or more vulnerable in certain areas, and therefore plan targeted training to reduce weaknesses and/or accentuate strengths.

The power supply necessary for the functioning of the hit detection equipment may be included in the central device 7. For example, a rechargeable lithium-ion battery can be placed there.

The invention allows for the discrimination of hits in real time. Indeed, the central device 7 can centralize at any time the information of received and delivered hits, and command not to detect hits delivered within a specific time interval after receiving a hit. It is sufficient to neutralize the creation of signals within a time interval of predetermined duration after receiving a signal from the opponent, indicating a received hit of sufficient intensity.

The sending of signals by contact, allows a reliable transmission of information and a precise application of the rules of discrimination of hits present in certain martial arts.

The hit detection surfaces and in particular the conductive surface 3 of the jersey 1 may be made of textile materials, the invention makes it possible to avoid the fighters having to wear a sensor-lined chest protector. Such a chest protector is heavy, rigid and expensive. Traditional clothing can be used as long as it is made at least in part of conductive materials, with the possible addition of protections under the clothing.

Although the above description is based on particular embodiments, it is by no means restrictive of the scope of the invention, and modifications may be made, in particular by substitution of technical equivalents or by a combination different from all or part of the characteristics developed above.

The invention claimed is:

1. Hit detection equipment, usable by a fighter and an opponent for martial arts such as taekwondo, karate or boxing, the equipment comprising:

a central device;

a valid surface, wherein said valid surface is as a surface of the opponent's body where a hit has to be struck to be valid according to one or more rules of martial arts; and at least one authorized surface, wherein said authorized surface is the areas authorized to strike hits according to one or more rules of martial arts;

wherein said valid surface comprises at least one conductive surface; and wherein said authorized surface comprises two conductive structures insulated from each other, intertwined with each other over the entirety of said authorized surface, and each connected to an electrical terminal, and configured so that a contact of said authorized surface on a conductive surface creates a short circuit between the two conductive structures; and wherein said central device comprises a transmitter of signals capable of being transmitted between a fighter and his opponent by means of contact between said authorized surface of said fighter and said conductive surface of said opponent.

2. The equipment according to claim 1, wherein said signals are low frequency signals.

3. The equipment according to claim 1, wherein said conductive structures are arranged in the form of two combs or two spirals, intertwined within each other.

4. The equipment according to claim 1, wherein said conductive surface comprises woven or knitted conductive yarns, in particular silver-coated polyamide or stainless steel conductive yarns.

5. The equipment according to claim 1, further comprising at least one impact sensor.

6. The equipment according to claim 1, further comprising a gyroscope, capable of detecting a 180° rotation.

7. The equipment according to claim 1, further comprising at least one visual transmitter capable of receiving a lighting command from said central device.

8. A method for detecting a hit struck by a fighter to an opponent, for martial arts such as taekwondo, karate or boxing, each equipped with hit detection equipment having a central device, a valid surface, and at least one authorized surface, the method comprising:

establishment of a contact between an authorized surface of said fighter and a valid surface of said opponent, wherein said authorized surface has two conductive structures;

detection of a short circuit between said two conductive structures of said authorized surface;

creation at the level of the equipment of said fighter of a low frequency signal characteristic of the hit;

sending, during said contact, said low frequency signal to the opponent's central device, by means of the contact between the authorized surface of said fighter and the valid surface of said opponent; and sending a lighting command to visual transmitters of the opponent's equipment during said contact.

9. The method according to claim 8 further comprising, at the opponent's equipment at the time of reception of a signal, and depending on the nature of the received signal, neutralizing the creation of signals for a predetermined period of time.

10. The equipment of claim 1 wherein said valid surface is a jersey and/or a helmet.

11. The equipment of claim 1 wherein said authorized surface is a glove and/or a shoe.

12. The equipment according to claim 2, wherein said low frequency signal is in the order of 100 kHz.

13. The equipment according to claim 5, wherein said at least one impact sensor is an accelerometer.

14. The equipment according to claim 7, wherein said at least one visual transmitter is a LED.

15. The method according to claim 8, wherein said visual transmitter is a LED.

16. Hit detection equipment, usable by a fighter and an opponent for martial arts such as taekwondo, karate or boxing, the equipment comprising:

a central device;

a valid surface, wherein said valid surface is as a surface of the opponent's body where a hit has to be struck to be valid according to one or more rules of martial arts; and at least one authorized surface, wherein said authorized surface is the areas authorized to strike hits according to one or more rules of martial arts;

wherein said valid surface comprises at least one conductive surface; and wherein said authorized surface comprises two conductive structures insulated from each other, intertwined with each other over the entirety of said authorized surface, and each connected to an electrical terminal, and configured so that a contact of said authorized surface on a conductive surface creates a short circuit between the two conductive structures;

wherein said central device comprises a transmitter of signals capable of being transmitted between a fighter and his opponent by means of contact between said authorized surface of said fighter and said conductive surface of said opponent; and wherein, upon establishment of a contact between an authorized surface of said fighter and a valid surface of said opponent, wherein said authorized surface has two conductive structures, and upon detection of a short circuit between said two conductive structures of said authorized surface, a creation at the level of the equipment of said fighter of a low frequency signal characteristic of the hit and sending, during said contact, said low frequency signal to the opponent's central device, by means of the contact between the authorized surface of said fighter and the valid surface of said opponent, and sending a lighting command to visual transmitters of the opponent's equipment during said contact.

* * * * *